US008215730B2

(12) United States Patent
Brown et al.

(10) Patent No.: US 8,215,730 B2
(45) Date of Patent: Jul. 10, 2012

(54) ADJUSTABLE AND SEPARABLE JOINING STRUCTURE

(75) Inventors: Andrew Brown, Anderson, SC (US); Michael Christopher Bayne, Easley, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 829 days.

(21) Appl. No.: 12/172,302

(22) Filed: Jul. 14, 2008

(65) Prior Publication Data

US 2010/0007249 A1 Jan. 14, 2010

(51) Int. Cl.
*A47B 96/04* (2006.01)
*A47B 88/00* (2006.01)

(52) U.S. Cl. ..... 312/402; 312/348.4

(58) Field of Classification Search ..... 312/402, 312/348.4, 109, 111
See application file for complete search history.

(56) References Cited

U.S. PATENT DOCUMENTS

| | | | | |
|---|---|---|---|---|
| 2,711,944 | A | 6/1955 | Meek et al. | |
| 2,775,501 | A * | 12/1956 | Kyllo | 312/348.4 |
| 4,022,415 | A * | 5/1977 | Roderick et al. | 248/298.1 |
| 4,090,753 | A * | 5/1978 | Rock et al. | 312/140 |
| 4,690,571 | A * | 9/1987 | Fulterer | 384/22 |
| 4,705,328 | A * | 11/1987 | Rock et al. | 312/330.1 |
| 4,815,798 | A * | 3/1989 | Rock et al. | 312/330.1 |
| 5,505,554 | A * | 4/1996 | Lautenschlager Horst et al. | 403/12 |
| 5,688,033 | A * | 11/1997 | Fleisch et al. | 312/348.4 |
| 6,447,083 | B1 * | 9/2002 | Chiapetta et al. | 312/404 |
| 6,622,873 | B2 * | 9/2003 | Hegrenes et al. | 211/26 |
| 7,449,635 | B2 * | 11/2008 | Wiant | 174/68.2 |
| 2004/0222725 | A1 * | 11/2004 | Park et al. | 312/405 |
| 2005/0127804 | A1 | 6/2005 | Kim et al. | |
| 2007/0132348 | A1 | 6/2007 | Kim et al. | |
| 2007/0182295 | A1 | 8/2007 | Kim et al. | |
| 2008/0074019 | A1 * | 3/2008 | Park et al. | 312/236 |

* cited by examiner

*Primary Examiner* — Darnell Jayne
*Assistant Examiner* — Timothy M Ayres
(74) *Attorney, Agent, or Firm* — Pearne & Gordon LLP

(57) ABSTRACT

In one aspect, an assembly includes an enclosure with an opening and a door for closing the opening. A first joining member is secured to the enclosure and a second joining member is secured to the door. The first and second joining members can be mechanically joined to one another in any one of a plurality of attitudes relative to one another and to be separated from one another. A third joining member is joined to at least one of the first and second joining members to establish an alignment position for the first and second joining members relative to one another. Following the separation of the first and second joining members, the alignment position established by the third joining member allows the first and second joining members to be rejoined in the same attitude as the attitude in which they were joined prior to being separated.

38 Claims, 4 Drawing Sheets

ADJUSTABLE AND SEPARABLE JOINING STRUCTURE

BACKGROUND OF THE INVENTION

This invention relates generally to mechanical joining structures and constructs that are both adjustable and separable and, in particular, to adjustable and separable mechanical joints that can be used to adjustably and separably join an enclosure to a door at an opening in the enclosure, such as in the case where the door functions to close the opening of a freezer compartment in a bottom-mount household refrigerator.

Typical bottom-mount household refrigerators include a fresh food compartment located at the upper portion of the refrigerator, where food items can be stored at temperatures above 32° Fahrenheit, and a freezer compartment located at the lower portion of the refrigerator, where food items can be maintained at temperatures substantially below 32° Fahrenheit. Various door or closure constructs are provided for closing the fresh food compartment and freezer compartment. For example, a single door hinged to the refrigerator cabinet can be employed to close off and provide access to the interior of the fresh food compartment. In addition, French-style doors hinged to the refrigerator cabinet can be used for the same purpose. In the case of the freezer compartments, doors can be provided that allow the opening to the interior of the freezer compartment to be opened and closed by movement of the doors substantially translationally to the freezer door opening. In other words, the doors slide outwardly from and inwardly toward the freezer compartment opening to provide access to the interior of the freezer compartment and to close the freezer compartment respectively. The doors can have attached to them bins, baskets and the like that travel with the doors as the doors are pulled outwardly from the freezer compartment opening and pushed inwardly toward the opening to close the freezer compartment. Bins, baskets and the like also can be provided in the freezer compartment that do not travel with the doors but must be separately brought outwardly from the interior of the fresh food compartment for access.

For a variety of reasons, such as, for example, the proper alignment of the freezer compartment door and the maintenance of a good sealing relationship between the sealing surface on the freezer compartment door and the complementary sealing surface at the freezer compartment opening, it is desirable to be able to adjust the positioning of the door in relation to the freezer compartment opening and the enclosing cabinet structure. This adjustment can be accomplished when the refrigerator is finally assembled so as to compensate for any misalignment that may have occurred during the manufacture of the refrigerator. It also can be desirable to free the freezer compartment doors from the structure that supports the doors at the freezer compartment openings and remove the doors in connection with the installation and servicing of the refrigerator. When the doors are returned to the supporting structure after having been removed, it is desirable that they be re-secured so as to assume essentially the same spatial relationship they had with relation to the freezer compartment opening and cabinet structure before they were removed.

SUMMARY OF THE INVENTION

According to one aspect, the present invention concerns a separable and adjustable mechanical joint that comprises a first joining member and a second joining member that are configured to be mechanically joined to one another in any one of a plurality of attitudes relative to one another and to be selectively separated from one another. The mechanical joint further includes a third joining member configured to be adjustably joined to at least one of the first joining member and the second joining member to establish an alignment position for the first joining member and the second joining member relative to one another when the first joining member and the second joining member are joined to one another at the any one of a plurality of attitudes relative to one another. Following the separation of the first joining member from the second joining member, the alignment position established by the third joining member allows the first joining member and the second joining member to be rejoined in the same attitude relative to one another as the attitude in which they were joined prior to being separated from one another.

According to another aspect, the invention concerns an assembly wherein the first joining member is secured to an enclosure, such as the freezer compartment of a bottom-mount refrigerator, that includes an opening providing access to the interior of the enclosure and the second joining member is secured to a door configured to open and close the opening in the enclosure at least in part by substantially translational movement relative to the opening away from and toward the opening.

According to a further aspect, the third joining member is fixed to both the first joining member and the second joining member when the first joining member and the second joining member are joined together in the any one of a plurality of attitudes relative to one another. And the third joining member is fixed to one of the first joining member and the second joining member and is free of the other of the first joining member and the second joining member when the first joining member and the second joining member are separated from one another.

According to yet another aspect, the first joining member includes a first portion that includes a first surface and an opposing second surface, the second joining member includes a first portion that includes a first surface and an opposing second surface and the third joining member includes a first surface and an opposing second surface. The first portion of the first joining member and the first portion of the second joining member overlap one another. And the first surface of the first portion of the first joining member engages the second surface of the first portion of the second joining member and the second surface of the third joining member engages the first surface of the first portion of the second joining member, when the first joining member and the second joining member are joined together in the any one of a plurality of attitudes relative to one another.

According to yet a further aspect, at least one first fastener extends through the first portion of the first joining member and the first portion of the second joining member and is secured to the third joining member. The at least one first fastener is configured to hold together the first joining member, the second joining member and the third joining member when the at least one first fastener is secured to the third joining member and the first joining member and the second joining member are joined together in the any one of a plurality of attitudes relative to one another.

According to still another aspect, at least one second fastener extends through the first portion of the second joining member and is secured to the third joining member. The at least one second fastener is configured to hold together the second joining member and the third joining member both when the first joining member and the second joining member are joined together in the any one of a plurality of attitudes relative to one another and when the first joining member and the second joining member are separated from one another.

According to a particular aspect, two first fasteners and two second fasteners are included and are arranged substantially in a straight line with the two first fasteners comprising two outermost fasteners and the two second fasteners comprising two innermost fasteners. In an embodiment of this particular aspect, the two first fasteners and the two second fasteners are arranged substantially in a straight line that is substantially perpendicular to the direction in which the first joining member and the second joining member are separable from one another. In an additional particular aspect, two first fasteners and one second fastener are arranged substantially in a straight line with the two first fasteners comprising two outermost fasteners and the one second fastener comprising an innermost fastener.

According to still a further aspect, the first portion of the first joining member includes a respective through-opening in line with each of the at least one second fastener, the through-hole being of a size to allow the entirety of the at least one second fastener to pass through the through-opening.

According to another aspect, the first portion of the first joining member includes an embossment that is raised above the second surface of the first portion of the first joining member and forms a depression in the first surface of the first portion of the first joining member. And each through-opening in the first portion of the first joining member is located at the embossment.

According to a further aspect, the embossment is substantially L-shaped and comprises a first leg having a first end and a second end and a second leg having a first end and a second end with the second end of the first leg being joined to the second end of the second leg, The first leg of the substantially L-shaped embossment is arranged substantially perpendicular to the direction in which the first joining member and the second joining member are separable from one another, and the second leg of the substantially L-shaped embossment is arranged substantially parallel to the direction in which the first joining member and the second joining member are separable from one another.

According to yet another aspect, the first portion of the first joining member has a terminal edge and the first end of the second leg of the substantially L-shaped embossment extends through that terminal edge. A single through-opening is located substantially adjacent the first end of the first leg of the substantially L-shaped embossment.

According to yet a further aspect, the first joining member is either attached to or comprises a portion of a sliding-rail mechanism.

According to still another aspect, a sealing surface substantially surrounds the opening in the enclosure and the door includes a sealing surface that is substantially complementary with the sealing surface that surrounds the opening in the enclosure, whereby the door sealing surface and the sealing surface that substantially surrounds the opening engage one another when the opening is closed by the door. And the first joining member and the second joining member are secured to the enclosure and the door, respectively, and are configured so that adjustment of the first joining member and the second joining member in any one of the plurality of attitudes relative to one another adjusts the attitude of the door sealing surface in relation to the sealing surface that substantially surrounds the opening in the enclosure.

According to still a further aspect, the first joining member and the second joining member are connected to an apparatus, such as the enclosure and door of the freezer compartment of a bottom-mount refrigerator, respectively, for example, that has an interior and an exterior and the second surface of the first portion of the first joining member faces and is exposed to the exterior of the apparatus when the door is away from the opening in the enclosure.

DETAILED DESCRIPTION OF EMBODIMENTS OF THE INVENTION

Figure 1:
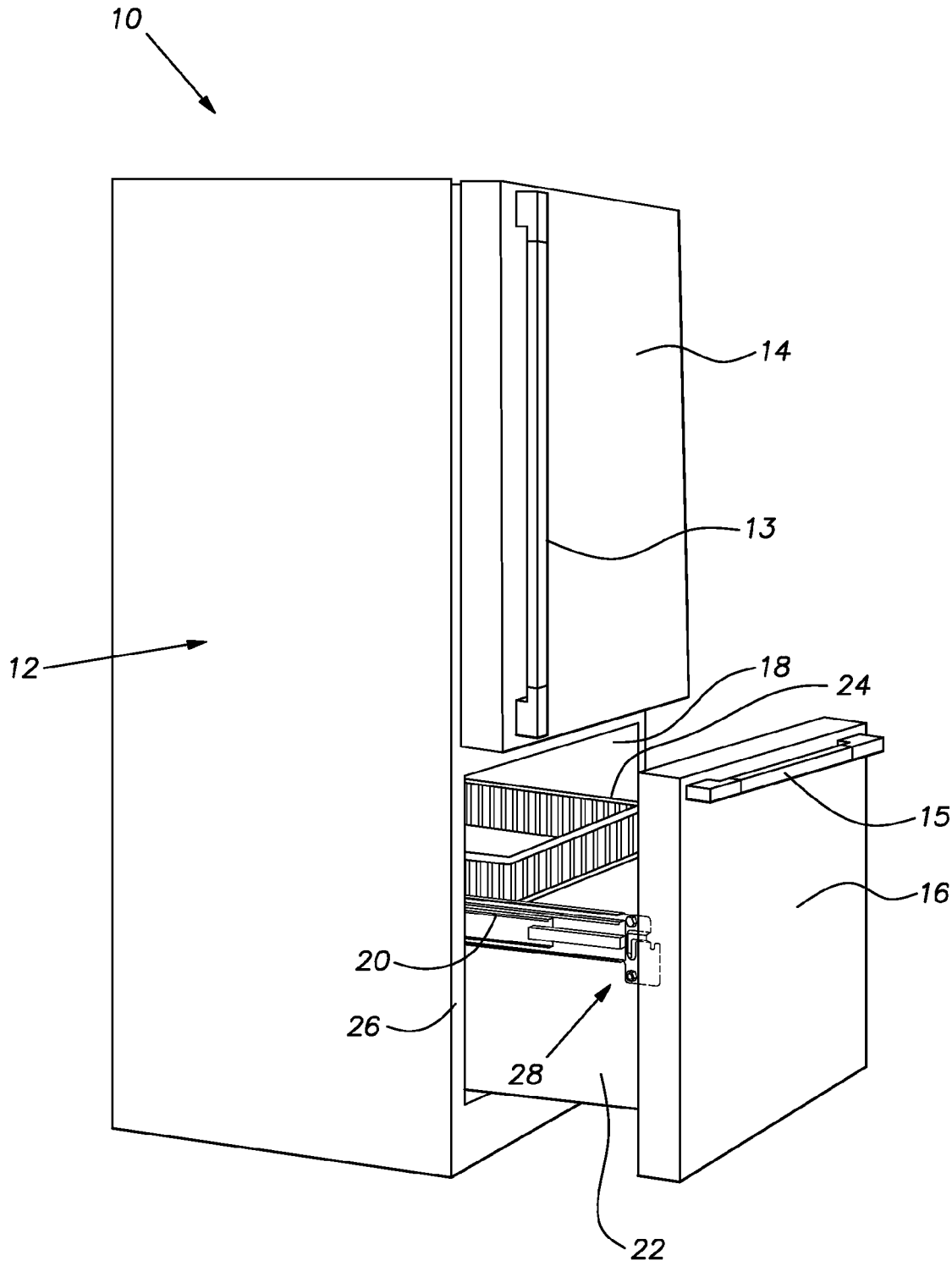
FIG. 1 is a perspective view of an embodiment of the invention that comprises a household bottom-mount refrigerator in which the door of the freezer compartment is adjustably and removably mounted.

Reference is first made to FIG. 1 for a description of an embodiment of the invention. FIG. 1 illustrates a household bottom-mount refrigerator, indicated generally at 10, and comprising a cabinet, indicated generally at 12, that houses at its upper portion a fresh food compartment that is typically maintained at a temperature of greater than 32° Fahrenheit and at its lower portion a freezer compartment that is typically maintained at a temperature substantially below 32° Fahrenheit. A door 14 is hinged at one side of the cabinet 12 opposite the handle 13 and closes off an opening at the front of the fresh food compartment through which access can be had to the interior of the fresh food compartment. And a door 16 closes off an opening 18 at the front of the freezer compartment through which access can be had to the interior of the freezer compartment. The door 16 is supported from telescoping sliding rails 20 located at each side of the door and is mounted to the interior side walls of the freezer compartment in a manner familiar to those having ordinary skill in the art so that the freezer compartment can be opened by sliding the door 16 out from the opening 18 and closed by sliding the door 16 in toward the opening 18 by means of the sliding rails 20. A handle 15 can be provided on the door 16 for that purpose. The freezer compartment thus comprises an enclosure including an opening providing access to the interior of the enclosure. Stated otherwise, the enclosure from which the door 16 is supported comprises a freezer compartment of a bottom-mount household refrigerator and the door 16 is configured to open and close the opening in the enclosure at least in part by substantially translational movement relative to the opening away from and toward the opening.

Storage bins such as are illustrated at 22 and storage baskets such as are illustrated at 24 in FIG. 1 can be provided within the freezer compartment of the refrigerator. The bins and baskets can be attached to the door 16 and supported by telescoping sliding rails or the like so that they travel with the door as it is opened and closed. Alternatively, the bins and baskets can be free of the door so that they must be brought outwardly and returned inwardly of the freezer compartment interior separately from the door 16 on telescoping sliding rails or the like from which they are supported. The door 16, bin 22 and basket 24 can be supported by sliding or gliding mechanisms of various types including telescoping, sliding rail mechanisms.

A sealing surface 26 substantially surrounds the opening 18 in the enclosure or freezer compartment, and the door 16 at its back side, which is not visible in FIG. 1, includes a sealing surface that is substantially complementary with the sealing surface 26 that surrounds the opening in the freezer compartment. The door sealing surface and the sealing surface substantially surrounding the opening 18 engage one another when the opening 18 is closed by the door 16 so that the interior of the freezer compartment is sealed off from the exterior of the refrigerator 10. As will be familiar to those having ordinary skill in the art, rubber or plastic gaskets or seals or the like can be provided at the sealing surface 26 and at the complementary sealing surface at the back side of the door 16 in order to more certainly seal the freezer compartment interior from the outside environment.

As noted above, the door 16 is supported from the sliding rail mechanism 20 located at each side of the freezer compartment. And a separable and adjustable mechanical joint, indicated generally at 28 in FIG. 1, is provided between the door 16 and each sliding rail mechanism. As more completely described below, the mechanical joint 28 is separable at least in the sense that the joint can be disassembled and the door 16 separated from the sliding rail mechanism 20 and removed from the front of the freezer compartment. And the mechanical joint 28 is adjustable at least in the sense that the attitude of the door 16 in relation to the opening 18 and cabinet 12, and the attitude of the sealing surface 26 in relation to the sealing surface at the back side of the door 16, can be adjusted.

Typically, during the manufacture of a bottom-mount refrigerator of the type shown in FIG. 1, certain tolerances in the refrigerator's various components are allowed. As a result, it can be the case that final assembly of the refrigerator results in some misalignment of parts. In particular, it can develop that the door of the freezer compartment is misaligned with the opening in the freezer compartment, the refrigerator cabinet or both and/or the sealing surfaces at the freezer compartment opening and the back side of the door can be misaligned. Consequently, it can be necessary to adjust the attitude of the freezer compartment door in relation to the freezer compartment opening and/or the refrigerator cabinet, including the sealing surfaces at the freezer compartment opening and the back side of the door, and such an adjustment typically is initially performed at the manufacturing site although such an adjustment can otherwise be performed as necessary. Additionally, it can be necessary or desirable to be able to remove the door of the freezer compartment in connection, for example, with the delivery of the refrigerator to the customer or the servicing of the refrigerator. And when the door is reinstalled after having been removed, it is desirable that the door be returned to the attitude it had prior to being removed as that attitude may have been established at the manufacturing site or otherwise. The adjustable mechanical joint 28 provides for the attainment of these desiderata.

Figure 2:
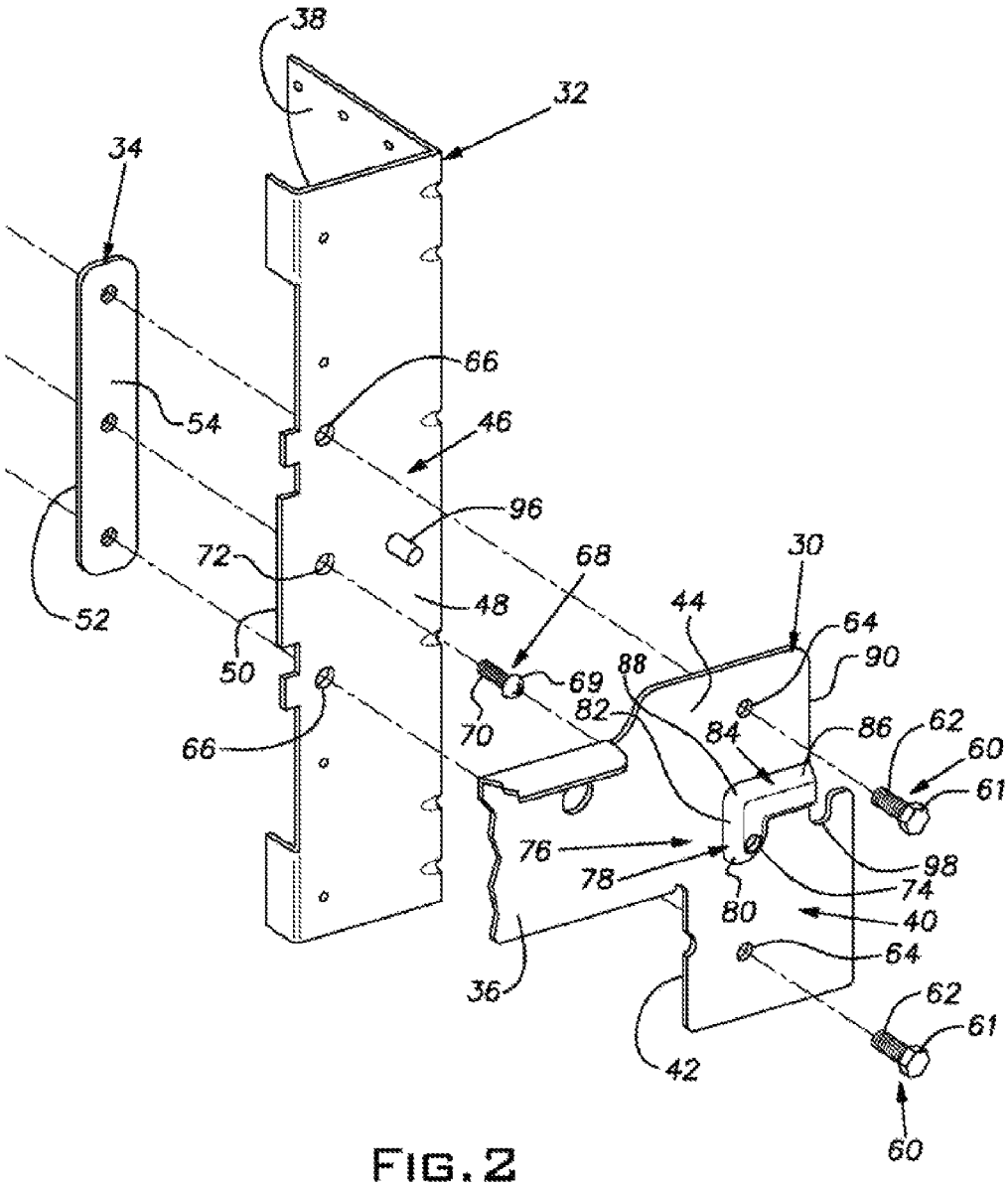
FIG. 2 is an exploded, partial perspective view, with certain parts broken away, of an embodiment of an adjustable and separable mechanical joint that can be applied to a freezer compartment and freezer compartment door of a bottom-mount refrigerator of the type shown in FIG. 1, whereby the attitude of the freezer compartment door can be adjusted in relation to the freezer compartment and the freezer door can be removed or separated from the freezer compartment.
Figure 3:
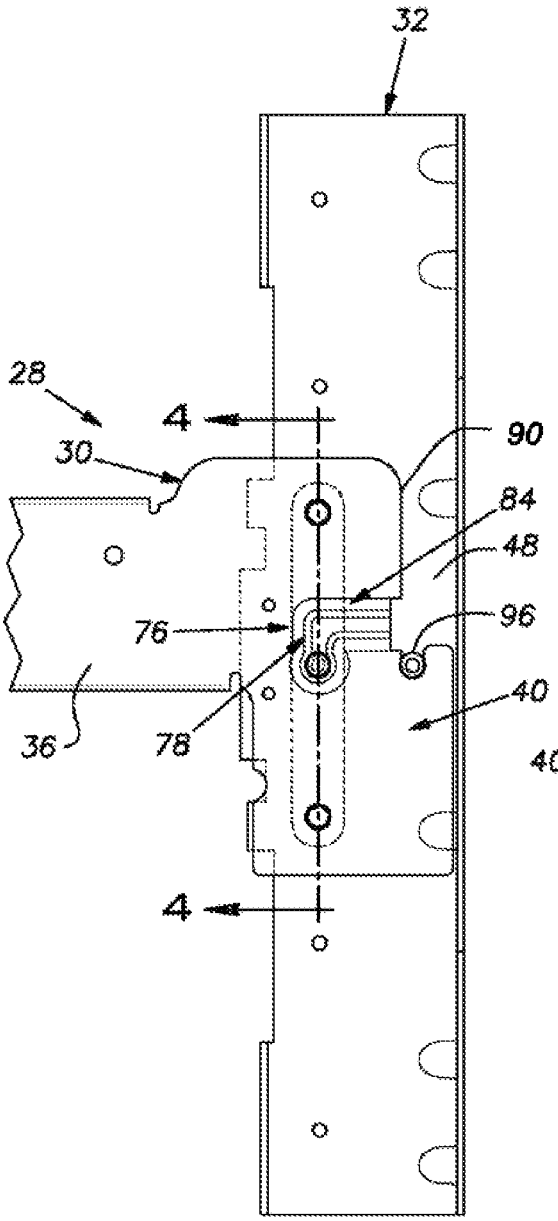
FIG. 3 is a side elevational view of the mechanical joint of FIG. 2 when assembled.
Figure 4:
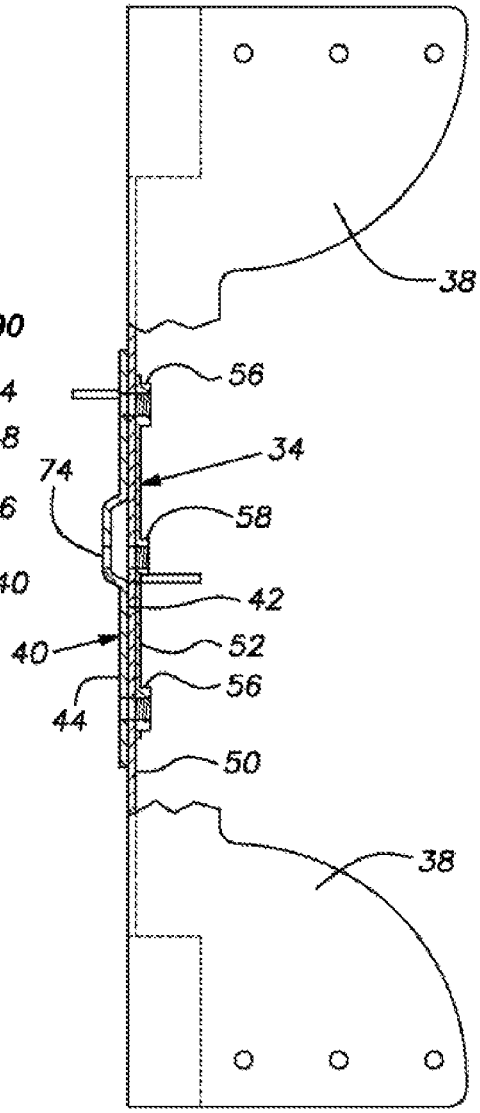
FIG. 4 is a front elevational view of the assembled mechanical joint of FIG. 3 partly in cross-section along line 4-4 of FIG. 3.

Details of the separable and adjustable mechanical joint 28 can best be seen in FIGS. 2, 3 and 4 wherein for the sake of descriptive clarity the joint alone is illustrated without reference to its attachment to the telescoping sliding rail 20 or the door 16. The mechanical joint 28 comprises a first joining member, indicated generally at 30, a second joining member, indicated generally at 32, and a third joining member, indicated generally at 34. The first joining member 30 is secured to the freezer compartment or enclosure by the integration of a portion 36 of the first joining member 30 to the telescoping sliding rail mechanism 20 that is secured to an interior wall of the freezer compartment, whereby the first joining member comprises a portion of the sliding-rail mechanism 20. The first joining member 30 also can comprise an element separate from the mechanism 20 and be attached to the mechanism by suitable attaching means. The second joining member 32 is secured to the door 16 at the back of the door by means of the flanges 38 that can be attached to the door by fasteners or by welding for example.

The first joining member 30 includes a first portion, indicated generally at 40, including a first surface 42 and an opposing second surface 44. And the second joining member 32 includes a first portion, indicated generally at 46, including a first surface 48 and an opposing second surface 50. The third joining member 34 includes a first surface 52 and an opposing second surface 54 as well as two outside threaded portions 56 and an inside threaded portion 58 as best seen in FIG. 4.

When the mechanical joint 28 is assembled, as best seen in FIGS. 3 and 4, the first portion 40 of the first joining member 30 and the first portion 46 of the second joining member 32 overlap one another. At the same time, the first surface 42 of the first portion 40 of the first joining member 30 engages the second surface 48 of the first portion 46 of the second joining member 32 and the second surface 54 of the third joining member 34 engages the first surface 50 of the first portion 46 of the second joining member 32. This relationship among the three joining members exists whenever the first joining member 30 and the second joining member 32 are joined together in the any one of a plurality of attitudes relative to one another as is further discussed below.

Also when the mechanical joint is assembled, the assembly as heretofore described includes, as best seen in FIG. 2, at least one adjustable first fastener, indicated generally at 60, having a first end 61 and a second end 62. In the embodiment of the invention shown in the drawings, two fasteners 60 in the form of machine bolts are shown but any number or other types of fasteners can be employed. For the sake of clarity, the fasteners 60 are not shown in place in FIGS. 3 and 4 but based on FIG. 2, it will be understood that the at least one first fastener 60 extends through the first portion 40 of the first joining member 30, through the opening 64 which is of substantially the same diameter as the threaded shank of the fastener 60, and through the first portion 46 of the second joining member 32, through the opening 66 which is of a size greater than the diameter of the threaded shank of fastener 60, and is secured to the third joining member 34, at a threaded opening in the threaded portion 56 of the third joining member 34. The shank of the at least one adjustable fastener 60, which is threaded, is screwed into the complementarily threaded opening in the threaded portion 56 of the third joining member 34, whereby the at least one adjustable fastener 60 is configured to hold together the first joining member 30, the second joining member 32 and the third joining member 34 when the three joining members are joined together in any one of a plurality of attitudes relative to one another as described below. In the illustrated embodiment, the three joining members are held together by the first end 61 of the fastener 60 bearing against the second surface 44 of the first portion 40 of the first joining member 30 and the second end 62 of the fastener 60 drawing the third joining member 34 tightly against the second joining member 32.

The described assembly also includes at least one second fastener, indicated generally at 68, and having a first end 69 and a second end 70. The at least one second fastener 68 extends through the first portion 46 of the second joining member 32, through the opening 72 which is of a size greater than the diameter of the threaded shank of the fastener 68, and is secured to the third joining member 34, at a threaded opening in the threaded portion 58 of the third joining member 34. The shank of the at least one second adjustable fastener 68, which is threaded, is screwed into the complementarily threaded opening in the threaded portion 58 of the third joining member 34 whereby, the at least one adjustable fastener 68 is configured to hold together the second joining member 32 and the third joining member 34 both when all three joining members are joined together in any one of a plurality of attitudes relative to one another as described below as well as when the first joining member 30 and the second joining member 32 are separated from one another, also as described below. In the illustrated embodiment, the second joining member 32 and the third joining member 34 are held together by the first end 69 of the fastener 68 bearing against the second surface 48 of the first portion 46 of the second joining member 32 and the second end 70 of the fastener 68 drawing the third joining member 34 tightly against the second joining member 32.

As has been described, the embodiment of the assembly of FIGS. 1 through 4 includes two first fasteners 60 and one second fastener 68. The three fasteners are arranged substantially in a straight line with the two first fasteners 60 comprising two outermost fasteners and the one second fastener 68 comprising an innermost fastener.

The first portion 40 of the first joining member 30 includes a through-opening 74 that is in line with the at least one second fastener 68 thereby allowing a respective one of the at least one second fastener to pass through the through-opening and allowing access to the first end 69 of the at least one second fastener 68. In the embodiment shown in FIGS. 1 through 4, the through-opening 74 is located in an embossment, indicated generally at 76, that is located in the first portion 40 of the first joining member 30. The embossment 76 is raised above the second surface 44 of the first portion 40 of the first joining member 30 and forms a depression in the first surface 42 of the first portion 40 of the first joining member 30. When the mechanical joint 28 is assembled as shown in FIGS. 3 and 4, the first end 69 of the second adjustable fastener is located in the depression in the first surface 42 of the first portion 40 of the first joining member 30 formed by the embossment 76 opposite the through-hole 74.

The embossment 76 is substantially L-shaped and comprises a first leg 78 that has a first end 80 and a second end 82 and a second leg 84 that has a first end 86 and a second end 88. The second end 82 of the first leg 78 is joined to the second end 88 of the second leg 84. The first leg 78 of the substantially L-shaped embossment 76 is arranged substantially perpendicular to the direction in which the first joining member 30 and the second joining member 32 are separable from one another as described below, and the second leg 84 of the substantially L-shaped embossment is arranged substantially parallel to the direction in which the first joining member 30 and the second joining member 32 are separable from one another, also as described below. The first portion 40 of the first joining member 30 has a terminal edge 90 and the first end 86 of the second leg 84 of the substantially L-shaped embossment 76 extends through the terminal edge 90 of the first portion 40 of the first joining member 30. And the single through-opening 74 is located substantially adjacent the first end 80 of the first leg 78 of the substantially L-shaped embossment 76.

Figure 5:
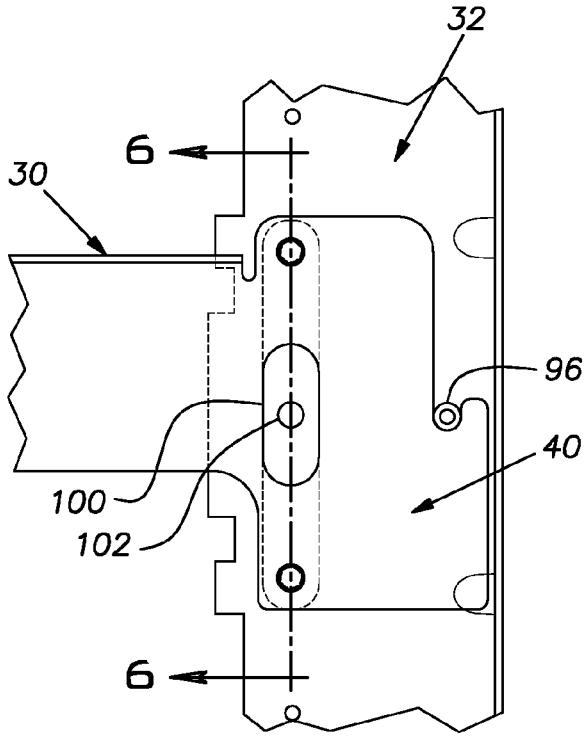
FIG. 5 is a side elevational view of a second embodiment of a separable and adjustable mechanical joint that can be applied to a freezer compartment and freezer compartment door of a bottom-mount refrigerator of the type shown in FIG. 1, whereby the attitude of the freezer compartment door can be adjusted in relation to the freezer compartment and the freezer door can be removed or separated from the freezer compartment.
Figure 6:
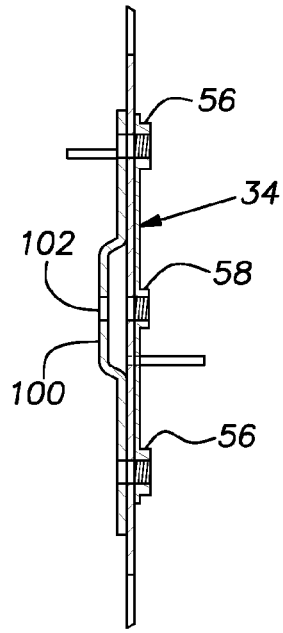
FIG. 6 is a cross-sectional view along line 6-6 of FIG. 5.

FIGS. 5 and 6 of the drawings illustrate another embodiment of the invention wherein, rather than a substantially L-shaped embossment being provided in the first portion 40 of the first joining member 30, a substantially linear embossment 100 is provided. The embossment is arranged such that its longitudinal dimension and the through-hole 102 located in the embossment and beneath which a second fastener 68 is located, are positioned in line with the two first fasteners 60 that hold together the first, second and third joining members 30, 32 and 34.

Figure 7:
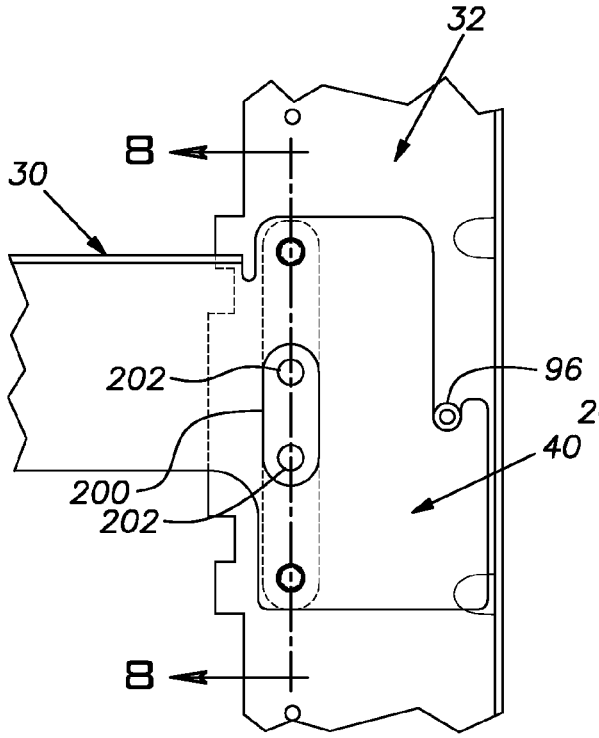
FIG. 7 is a side elevational view of a third embodiment of a separable and adjustable mechanical joint that can be applied to a freezer compartment and freezer compartment door of a bottom-mount refrigerator of the type shown in FIG. 1, whereby the attitude of the freezer compartment door can be adjusted in relation to the freezer compartment and the freezer door can be removed or separated from the freezer compartment.
Figure 8:
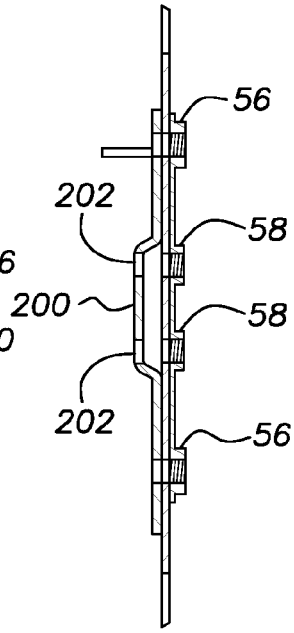
FIG. 8 is a cross-sectional view along line 8-8 of FIG. 7.

FIGS. 7 and 8 of the drawings illustrate a further embodiment of the invention wherein, as in the embodiment of FIGS. 5 and 6, a linear embossment 200 is provided. However in the embodiment of FIGS. 7 and 8, two through-holes 202 are located in the embossment beneath each of which is located a second fastener 68. This embodiment thus includes two first fasteners 60 and two second fasteners 68 that are arranged substantially in a straight line with the two first fasteners 60 comprising two outermost fasteners that hold together the first, second and third joining members 30, 32 and 34 and the two second fasteners 68 comprising two innermost fasteners. Further, in this embodiment, although it need not be the case, the two first fasteners 60 and the two second fasteners 68 are arranged substantially in a straight line that is substantially perpendicular to the direction in which the first joining member 30 and the second joining member 32 are separable from one another as described below.

The several embodiments of the invention described above provide for assemblies and mechanical joints wherein the first joining member and the second joining member of the mechanical joints are configured to be mechanically joined to one another in any one of a plurality of attitudes relative to one another and to be selectively separated from one another. And with reference to the embodiment of the invention where sealing surfaces are provided both at a door that closes off an opening in an enclosure and substantially surrounding the opening in the enclosure, the first joining member and the second joining member are configured and are secured to the enclosure and the door respectively, so that adjustment of the first joining member and the second joining member relative to one another in any one of the plurality of attitudes relative to one another adjusts the attitude of the door sealing surface in relation to the sealing surface substantially surrounding the opening in the enclosure. Thus, with reference to FIGS. 2, 3 and 4 of the drawings, by making through-openings 66 larger than the diameter of the threaded shank of the first fasteners 60, the first joining member 30, which is joined to the second joining member 32 through the instrumentality of the first fasteners 60 being screwed into the threaded portions 56 of the third joining member 34, can be adjusted upwardly, downwardly and/or laterally in relation to the second joining member 32 when the first fasteners are not tightly engaged so as to enable the first joining member and the second joining member to be positioned in a desired attitude relative to one another. After the first joining member and the second joining member are positioned in the desired attitude relative to one another, the first fasteners 60 are tightened and the first joining member 30 and the second joining member 32 are secured to one another in that desired attitude. Because the door 16 in the embodiment of FIGS. 2, 3 and 4 is secured to the second joining member 32 and the first joining member 30 is secured to the enclosure or freezer compartment, adjustment of the first joining member 30 in relation to the second joining member 32 adjusts the attitude of the door 16 in relation to the freezer compartment and the door sealing surface in relation to the sealing surface 26 substantially surrounding the opening in the enclosure.

The third joining member 34 is configured to be adjustably joined to at least one of the first joining member 30 and the second joining member 32 to establish an alignment position for the first joining member and the second joining member relative to one another when the first joining member and the second joining member are joined to one another at the any one of a plurality of attitudes relative to one another. Thus in the embodiment of FIGS. 2, 3 and 4, after the first joining member 30 and the second joining member 32 are positioned in a desired attitude relative to one another and secured to one another, the third joining member 34 is secured to the second joining member 32 by the instrumentality of the second fastener 68 being screwed into the threaded portion 58 of the third joining member until the second and third joining members are tightly secured to one another. In this connection, the through-opening 72 in the second member 32 is made larger than the diameter of the threaded shank of the second fastener 68 so as to allow for the passage of the second fastener therethrough notwithstanding the prior adjustment of the first and second joining members relative to one another which can result in the through-opening 72 not being precisely in line with the threaded portion 58 of the third joining member 34.

When an occasion arises that requires the separation of the first joining member 30 from the second joining member 32, such as when the door 16 door is to be removed from the front of the freezer compartment for performing service, it is only necessary to undo and remove the first fasteners 60 while the second joining member 32 and the third joining member 34 remain secured to one another by means of the second fasteners 68. With the embodiments of the invention that are illustrated in the drawings, this can be readily accomplished since the second surface 44 of the first portion 40 of the first joining member 30 faces and is exposed to the exterior of the enclosure or freezer compartment when the door 16 is away form the opening 18 in the enclosure. Thereafter, the door 16 is raised substantially vertically during which movement the first end 69 of the second fastener 68 passes along the recess formed by the first leg 80 of the embossment 76 until the first end 69 of the second fastener 68 reaches the location where the second end 82 of the first leg 80 of the embossment 76 and the second end 88 of the second leg 84 of the embossment 76 are joined. At that location, the door 16 is moved substantially horizontally so that the first end 69 of the second fastener 68 passes along the recess formed by the second leg 84 of the embossment 76 until the first end 69 of the second fastener 68 moves past the terminal edge 90 of the first joining member 30 and the first and second joining members are then separated from one another.

When the door 16 is removed, the second and third joining members 32 and 34 remain secured to one another in the same relative positions as they had when the door 16 was mounted to the first joining member 30. Thereby, following the separation of the first joining member 30 and the second joining member 32, the alignment position established by the third joining member 34 allows the first joining member 30 and the second joining member 32 to be rejoined, such as when the door 16 is reinstalled, in the same attitude relative to one another as the attitude in which they were joined prior to being separated from one another. The reinstallation of the door is facilitated by the support pin 96 that is fixedly attached to the second joining member 32 and the complementary notch 98 provided in the first portion 40 of the first joining member 30. Thus, when the door is returned to the first joining member 30, the door can be supported in an approximate mounting position by placing the support pins 96 in the complementary notches 98 and the first fasteners 60 then resecured so as to rejoin the first, second and third joining members.

According to the present invention, the third joining member 34 is fixed to both the first joining member 30 and the second joining member 32 when the first joining member and the second joining member are joined together in the any one of a plurality of attitudes relative to one another. And the third joining member 34 is fixed to one of the first joining member 30 and the second joining member 32 and is free of the other of the first joining member and the second joining member when the first joining member and the second joining member are separated from one another. In the illustrated embodiments, the third joining member 34 is fixed to the second joining member 32 and is free of the first joining member 30 when the first joining member and the second joining member are separated from one another.

In each of the embodiment of FIGS. 5 and 6 and the embodiment of FIGS. 7 and 8, the manipulation of the first, second and third joining members 30, 32 and 34 is substantially the same as described with respect to the embodiment of FIGS. 2, 3 and 4. However, in each of the embodiment of FIGS. 5 and 6 and the embodiment of FIGS. 7 and 8, only a substantially vertically arranged embossment is provided and in the latter embodiment two second fasteners rather than one second fastener are provided. Consequently, when the first joining member 30 and the second joining member 32 are separated from one another, it may be necessary to separate the two joining members somewhat laterally from one another to permit the first ends 69 of the second fasteners 68 located within the recesses of the embossments 100 and 200 to slide beneath the first portions 40 of the first joining members 30. It also is to be noted that mechanical joints and assemblies can be provided wherein no recess is provided in the first portion 40 of the first joining member 30 and the through-hole in the first portion of the first joining member is large enough to allow the first end of the second fasteners to pass through. In such a case, it may be necessary to somewhat forcibly separate the first and second joining members 30 and 32 laterally from one another when they are being separated so that the first ends 69 of the second fasteners 68 can pass beneath the first portion 40 of the first joining member 30. However, locating the first end 69 of the second fastener within a recess of an embossment provided in the first portion 40 of the first joining member 30 minimizes the risk that the second fasteners can be accessed or accidentally loosened when the mechanical joint 28 is assembled and thus minimizes the risk that the alignment position of the third joining member 34 can be disturbed except when necessary.

Although several embodiments of the invention have been described in detail with reference to a bottom-mount household refrigerator and in particular to the freezer compartment being located at the lower portion of a refrigerator, the present invention can be applied to other compartments of household refrigerators as well as to other kinds of enclosures such as miscellaneous storage cabinets of various types for example. Additionally, the adjustable and separable mechanical joint of the invention can be employed in other circumstances where it is desired to provide one joining member that is adjustably joined to another joining member and where it is further desired that the joining members be capable of being separated and then returned to their joined condition where they assume the same attitude with respect to one another as they had prior to being separated.

What is claimed is:

1. An assembly including:

an enclosure including an opening providing access to the interior of the enclosure;

a door configured to open and close the opening in the enclosure at least in part by substantially translational movement relative to the opening away from and toward the opening;

a first joining member secured to the enclosure and a second joining member secured to the door, the first joining member and the second joining member being configured to be mechanically joined and fixed to one another in any one of a plurality of possible attitudes and to be selectively separated from one another, the first joining member includes an embossment with a through-opening, the embossment forms a depression on a first surface of the first joining member and is raised above a second surface of the first joining member, the first surface opposes the second surface; and a third joining member that is plate-shaped, the third joining member configured to be adjustably joined to at least one of the first joining member and the second joining member to establish an alignment position for the first joining member and the second joining member relative to one another when the first joining member and the second joining member are joined to one another at the any one of a plurality of attitudes relative to one another, whereby, following the separation of the first joining member and the second joining member, the alignment position established by the third joining member allows the first joining member and the second joining member to be rejoined in the same attitude relative to one another as the attitude in which they were joined prior to being separated from one another.

2. The assembly of claim 1 wherein:

the third joining member is fixed to both the first joining member and the second joining member when the first joining member and the second joining member are joined together in the any one of a plurality of attitudes relative to one another; and the third joining member is fixed to one of the first joining member and the second joining member and is free of the other of the first joining member and the second joining member when the first joining member and the second joining member are separated from one another.

3. The assembly of claim 1 wherein;

a sealing surface substantially surrounds the opening in the enclosure;

the door includes a sealing surface that is substantially complementary with the sealing surface that substantially surrounds the opening in the enclosure, whereby the door sealing surface and the sealing surface that substantially surrounds the opening engage one another when the opening is closed by the door; and the first joining member and the second joining member are secured to the enclosure and the door, respectively, and are configured so that adjustment of the first joining member and the second joining member in any one of the plurality of attitudes relative to one another adjusts the attitude of the door sealing surface in relation to the sealing surface that substantially surrounds the opening in the enclosure.

4. The assembly of claim 1 wherein the first joining member is either attached to or comprises a portion of a sliding-rail mechanism.

5. The assembly of claim 1 wherein the enclosure comprises a freezer compartment of a bottom-mount household refrigerator.

6. The assembly of claim 1 wherein:

the first joining member includes a first portion including the first surface and the opposing second surface;

the second joining member includes a first portion including a first surface and an opposing second surface;

the third joining member includes a first surface and an opposing second surface; and the first portion of the first joining member and the first portion of the second joining member overlap one another, the first surface of the first portion of the first joining member engages the first surface of the first portion of the second joining member and the second surface of the third joining member engages the second surface of the first portion of the second joining member, when the first joining member and the second joining member are joined together in the any one of a plurality of attitudes relative to one another.

7. The assembly of claim 6 including at least one first fastener extending through the first portion of the first joining member and the first portion of the second joining member and secured to the third joining member, the at least one first fastener being configured to hold together the first joining member, the second joining member and the third joining member when the at least one first fastener is secured to the third joining member and the first joining member and the second joining member are joined together in the any one of a plurality of attitudes relative to one another.

8. The assembly of claim 7 including at least one second fastener extending through the first portion of the second joining member and secured to the third joining member, the at least one second fastener being configured to hold together the second joining member and the third joining member both when the first joining member and the second joining member are joined together in the any one of a plurality of attitudes relative to one another and when the first joining member and the second joining member are separated from one another.

9. The assembly of claim 8 wherein the first portion of the first joining member includes the respective through-opening in line with each of the at least one second fastener, the through-hole being of a size to allow the entirety of the at least one second fastener to pass through the through-opening.

10. The assembly of claim 9 wherein the second surface of the first portion of the first joining member faces and is exposed to the exterior of the enclosure when the door is away from the opening in the enclosure.

11. The assembly of claim 9 wherein the first portion of the first joining member includes the embossment that is raised above the second surface of the first portion of the first joining member and forms a depression in the first surface of the first portion of the first joining member and each through-opening in the first portion of the first joining member is located at the embossment.

12. The assembly of claim 11 wherein;

a sealing surface substantially surrounds the opening;

the door includes a sealing surface that is substantially complementary with the sealing surface that surrounds the opening in the enclosure, whereby the door sealing surface and the sealing surface that substantially surrounds the opening engage one another when the opening is closed by the door; and the first joining member and the second joining member are secured to the enclosure and the door, respectively, and are configured so that adjustment of the first joining member and the second joining member in any one of the plurality of attitudes relative to one another adjusts the attitude of the door sealing surface in relation to the sealing surface that substantially surrounds the opening in the enclosure.

13. The assembly of claim 12 wherein the first joining member is either attached to or comprises a portion of a sliding-rail mechanism.

14. The assembly of claim 12 wherein the enclosure comprises a freezer compartment of a bottom-mount household refrigerator.

15. The assembly of claim 11 wherein the embossment is substantially L-shaped and comprises a first leg having a first end and a second end and a second leg having a first end and a second end, the second end of the first leg being joined to the second end of the second leg, the first leg of the substantially L-shaped embossment being arranged substantially perpendicular to the direction in which the first joining member and the second joining member are separable from one another and the second leg of the substantially L-shaped embossment being arranged substantially parallel to the direction in which the first joining member and the second joining member are separable from one another.

16. The assembly of claim 15 wherein the first portion of the first joining member has a terminal edge and the first end of the second leg of the substantially L-shaped embossment extends through the terminal edge of the first portion of the first joining member and a single through-opening is located substantially adjacent the first end of the first leg of the substantially L-shaped embossment.

17. The assembly of claim 16 wherein:

a sealing surface substantially surrounds the opening in the enclosure;

the door includes a sealing surface that is substantially complementary with the sealing surface that surrounds the opening in the enclosure, whereby the door sealing surface and the sealing surface that substantially surrounds the opening engage one another when the opening is closed by the door; and the first joining member and the second joining member are secured to the enclosure and the door, respectively, and are configured so that adjustment of the first joining member and the second joining member in any one of the plurality of attitudes relative to one another adjusts the attitude of the door sealing surface in relation to the sealing surface that substantially surrounds the opening in the enclosure.

18. The assembly of claim 17 wherein the enclosure comprises a freezing compartment of a bottom-mount household refrigerator.

19. The assembly of claim 18 wherein the first joining member is either attached to or comprises a portion of a sliding-rail mechanism.

20. The assembly of claim 11 including two first fasteners and two second fasteners arranged substantially in a straight line with the two first fasteners comprising two outermost fasteners and the two second fasteners comprising two innermost fasteners.

21. The assembly of claim 11 including two first fasteners and one second fastener arranged substantially in a straight line with the two first fasteners comprising two outermost fasteners and the one second fastener comprising an innermost fastener.

22. The assembly of claim 20 wherein the two first fasteners and the two second fasteners are arranged substantially in a straight line that is substantially perpendicular to the direction in which the first joining member and the second joining member are separable from one another.

23. A separable and adjustable mechanical joint comprising:

a first joining member and a second joining member configured to be mechanically joined and fixed to one another in any one of a plurality of attitudes relative to one another and to be selectively separated from one another, the first joining member includes an embossment with a through-opening, the embossment forms a depression on a first surface of the first joining member and is raised above a second surface of the first joining member, the first surface opposes the second surface; and a third joining member that is plate-shaped, the third joining member configured to be adjustably joined to at least one of the first joining member and the second joining member to establish an alignment position for the first joining member and the second joining member relative to one another when the first joining member and the second joining member are joined to one another at the any one of a plurality of attitudes relative to one another, whereby, following the separation of the first joining member from the second joining member, the alignment position established by the third joining member allows the first joining member and the second joining member to be rejoined in the same attitude relative to one another as the attitude in which they were joined prior to being separated from one another.

24. The separable and adjustable mechanical joint of claim 23 wherein:

the third joining member is fixed to both the first joining member and the second joining member when the first joining member and the second joining member are joined together in the any one of a plurality of attitudes relative to one another; and the third joining member is fixed to one of the first joining member and the second joining member and is free of the other of the first joining member and the second joining member when the first joining member and the second joining member are separated from one another.

25. The separable and adjustable mechanical joint of claim 24 wherein:

the first joining member includes a first portion including a first surface and an opposing second surface;

the second joining member includes a first portion including the first surface and the opposing second surface;

the third joining member includes a first surface and an opposing second surface; and the first portion of the first joining member and the first portion of the second joining member overlap one another, the first surface of the first portion of the first joining member engages the first surface of the first portion of the second joining member and the second surface of the third joining member engages the second surface of the first portion of the second joining member, when the first joining member and the second joining member are joined together in the any one of a plurality of attitudes relative to one another.

26. The separable and adjustable mechanical joint of claim 25 including at least one first fastener extending through the first portion of the first joining member and the first portion of the second joining member and secured to the third joining member, the at least one first fastener being configured to hold together the first joining member, the second joining member and the third joining member when the at least one first fastener is secured to the third joining member and the first joining member and the second joining member are joined together in the any one of a plurality of attitudes relative to one another.

27. The separable and adjustable mechanical joint of claim 26 including at least one second fastener extending through the first portion of the second joining member and secured to the third joining member, the at least one second fastener being configured to hold together the second joining member and the third joining member both when the first joining member and the second joining member are joined together in the any one of a plurality of attitudes relative to one another and when the first joining member and the second joining member are separated from one another.

28. The separable and adjustable mechanical joint of claim 27 wherein the first portion of the first joining member includes the respective through-opening in line with each of the at least one second fastener, the through-hole being of a size to allow the entirety of the at least one second fastener to pass through the through-opening.

29. The separable and adjustable mechanical joint of claim 28 wherein the first portion of the first joining member includes the embossment that is raised above the second surface of the first portion of the first joining member and forms a depression in the first surface of the first portion of the first joining member and each through-opening in the first portion of the first joining member is located at the embossment.

30. The separable and adjustable mechanical joint of claim 29 wherein the embossment is substantially L-shaped and comprises a first leg having a first end and a second end and a second leg having a first end and a second end, the second end of the first leg being joined to the second end of the second leg, the first leg of the substantially L-shaped embossment being arranged substantially perpendicular to the direction in which the first joining member and the second joining member are separable from one another and the second leg of the substantially L-shaped embossment being arranged substantially parallel to the direction in which the first joining member and the second joining member are separable from one another.

31. The separable and adjustable mechanical joint of claim 30 wherein the first portion of the first joining member has a terminal edge and the first end of the second leg of the substantially L-shaped embossment extends through the terminal edge of the first portion of the first joining member and a single through-opening is located substantially adjacent the first end of the first leg of the substantially L-shaped embossment.

32. The separable and adjustable mechanical joint of claim 29 including two first fasteners and two second fasteners arranged substantially in a straight line with the two first fasteners comprising two outermost fasteners and the two second fasteners comprising two innermost fasteners.

33. The separable and adjustable mechanical joint of claim 29 including two first fasteners and one second fastener arranged substantially in a straight line with the two first fasteners comprising two outermost fasteners and the one second fastener comprising an innermost fastener.

34. The separable and adjustable mechanical joint of claim 32 wherein the two first fasteners and the two second fasteners are arranged substantially in a straight line that is substantially perpendicular to the direction in which the first joining member and the second joining member are separable from one another.

35. The separable and adjustable mechanical joint of claim 23 wherein the first joining member comprises a portion of a sliding-rail mechanism.

36. The assembly of claim 1 wherein the first joining member is configured to be adjustable upwardly, downwardly, and laterally in relation to the second joining member.

37. The assembly of claim 1 further comprising at least one first fastener connecting the first joining member and the second joining member, and at least one second fastener connecting the second joining member and the third joining member, wherein removing the at least one first fastener disconnects the first joining member and the second joining member, and the second joining member and third joining member remain connected by the at least second fastener.

38. The assembly of claim 1, wherein the plurality of attitudes is at least three.

* * * * *